United States Patent [19]

Jacobsson

[11] 4,047,675

[45] Sept. 13, 1977

[54] THREAD STORING AND FEEDING DEVICE

[75] Inventor: Kurt Arne Gunnar Jacobsson, Ulricehamn, Sweden

[73] Assignee: Aktiebolaget IRO, Ulricehamn, Sweden

[21] Appl. No.: 654,954

[22] Filed: Feb. 3, 1976

[30] Foreign Application Priority Data

Feb. 4, 1975 Germany ..... 2504635

[51] Int. Cl.[2] ..... B65H 51/20

[52] U.S. Cl. ..... 242/47.01; 242/47.12

[58] Field of Search ..... 242/47.01, 47.12, 47.13; 66/132 R; 139/122 R

[56] References Cited

U.S. PATENT DOCUMENTS 3,419,225 12/1968 Rosen ..... 242/47.12

3,904,141 9/1975 Rosen ..... 242/47.12

3,924,818 12/1975 Pfeifle ..... 242/47.12 X

*Primary Examiner*—Stanley N. Gilreath

*Attorney, Agent, or Firm*—Blanchard, Flynn, Thiel, Boutell & Tanis

[57] ABSTRACT

A thread storing and feeding device, particularly for feeding thread in a sewing machine. The device includes a housing having a storage drum mounted thereon. The thread is tangentially fed onto the drum and is withdrawn over the end thereof. A sliding disc movable in the axial direction of the drum moves the thread supply over the drum. A control device is actuated by the sliding disc for controlling a winding drive. The sliding disc is mounted on a pivot lever, of which the end directed away from the sliding disc is tiltably mounted at a distance from the storage drum axle at least approximately equal to the drum radius.

17 Claims, 3 Drawing Figures

THREAD STORING AND FEEDING DEVICE

FIELD OF THE INVENTION

The invention relates to a thread storing and feeding device, particularly for feeding thread to a sewing machine, comprising a housing, a storage drum mounted thereon, to which drum the thread can be tangentially fed and from which it can be withdrawn overend, a sliding disc movable in the axial direction of the storage drum for moving the thread supply over the drum, and a device for controlling the winding drive, which device can be actuated by the sliding disc.

BACKGROUND OF THE INVENTION

Such a device is known from German Pat. No. 1,635,899. Its storage drum is rotationally drivable. The sliding disc is mounted on the end of the drum, in the vicinity of which the thread is delivered, and comprises arms extending outwardly through longitudinal slots in the drum wall. It is mounted so as to rotate with the drum and can be tilted about a pin passing transversely through the drum axle. A power storage element urges the sliding disc into the inclined position and the angle of inclination is dependent on the size of the thread supply on the storage drum. A microswitch can be actuated depending on this angle of tilt and in turn controls the winding drive, i.e. the drive for rotating the storage drum. By way of its control member which is in contact with a flange on the surface of the sliding disc remote from the drum, the microswitch acts simultaneously as a power storage element.

With a device of the described type a substantially smaller difference between the minimum and maximum thread supply occurs when the drum diameter is small and the microswitch is actuated with the angles of tilt being the same as with drums of large diameter, which results in frequent switching on and off of the winding drive. If a greater deflection is allowed for the minimum thread supply to compensate, i.e. a substantially greater incline for the tilted sliding disc, this leads to constructional problems. The slits through which the fingers of the sliding disc project must be lengthened, the fingers must also be made longer and thinner to ensure their smooth movement through the slits. However, when the angle of tilt is small, the longer fingers of the sliding disc then project further outwardly beyond the drum diameter. Also the free space on the outside of the drum is reduced when the angle of inclination of the disc is great. There is the danger that the wind-on thread may no longer come into contact with a free surface. Moreover, space must be provided on or outside the storage drum for the half which is pivoted upwardly when the angle of inclination of the sliding disc is great, thereby increasing the overall height of the device. This is not always desirable, particularly in the case of sewing machines where space for the necessary device must be kept to a minimum so as to allow unrestricted working.

The problem for the invention is to provide a thread storing and feeding device of the type described at the beginning of the specification, which enables adequate and positively controlled storage of thread by simple means and in this connection has relatively small dimensions.

This problem is solved in accordance with the invention by mounting the sliding disc on a pivot lever, of which the end directed away from the sliding disc is tiltably mounted at a distance from the storage drum axis at least approximately equal to the drum radius.

The mounting arrangement outside the area of the drum enables the sliding disc to be moved in an almost straight line axially to the drum when the thread supply changes. As a result the tilting of the sliding disc does not cause any increase or variation in space requirement. The arrangement of a practically only axially movable sliding disc in the drum area is in constructional terms simpler than that of a tiltable disc. In this connection it is unimportant whether the winding drive acts directly on the storage drum causing it to rotate conjointly with the sliding disc, or whether the storage drum and sliding disc are stationary and the winding drive moves a take-up element around the drum. The path of the thread being taken up onto the storage drum is not obstructed by the disc, irrespective of the size of the thread supply. Another important advantage of the device according to the invention is that no power storage element is required for the sliding disc, but its movement relative to the storage drum axis subject to the thread supply is determined by its own weight and that of its support.

The pivot lever advantageously actuates the device for controlling the winding drive. The position of the pivot lever is always determined by the position of the sliding disc. The control device, which does not have to fulfill an additional function as a power storage means, can therefore cooperate with any desired range of the lever. Its spatial arrangement is therefore adaptable within broad limits to the other constructional factors of the thread storing and feeding device.

The section of the pivot lever remote from the pivot bearing extends advantageously beyond the center of the storage drum. The sliding disc can then be suspended from the pivot lever at least on either side of the drum axle, i.e. symmetrically thereto, which produces positive guiding. The pivot lever is lengthened without a particularly large amount of space required, and particularly without the distance between the drum axle and pivot bearing becoming relatively great. Its free end thereby obtains a great and almost linear path of deflection which affords advantages particularly in cooperating with the control device.

The lever can be associated with a stop member in the housing which limits the tilting movement of the lever in both directions. The limits of movement of the sliding disc relative to the storage drum and therefore the desired minimum or maximum thread supply can be determined by adjusting this stop member.

The stop member is advantageously provided in the vicinity of the pivot lever end remote from the bearing, which is the point of maximum lever deflection.

In a preferred embodiment the pivot lever is designed substantially as a plate having a width approximately equal to the diameter of the drum. The lever is therefore stable, absorbs evenly the forces transmitted thereto by the sliding disc and ensures a steady and positive pivoting action adapted to suit the thread supply. The fastening elements are provided with sufficient area for the symmetrical fitting of the sliding disc.

Simple and economical mounting of the pivot lever is achieved by the fact that the lever acts as a rocker and has grooves or recesses which extend around corresponding projections on the housing.

For a device comprising a storage drum rotatably driven by the winding drive, the pivot lever can be connected to a bearing plate arranged between it and the sliding disc by retaining elements and the bearing plate to the sliding disc by rotary bearings. The bearing plate both allows the rotary bearings for the sliding disc to be mounted relatively remotely from the pivot lever, even inside the drum, and supported in the proximity of the drum axle relative to which they must be vertically movable. Such statically advantageous mounting of the rotary bearings directly on the pivot lever replaces the arrangement of the rotary bearings for the drum axle and/or its supports on a housing bottom between the lever and the drum. The bearing plate furthermore permits the use of simple retaining elements, for example screws, since they make possible a connection between two parallel plates inclined towards one another.

In a preferred embodiment the sliding disc comprises an edge extending around the upper drum edge of U-shaped cross section and having fingers forming the free U-shaped side and engaging in an inward direction in longitudinal slits in the storage drum.

In the area of its end remote from the bearing, the pivot lever can comprise a nose projecting laterally in its main plane and cooperating with a microswitch provided in this section. The microswitch can therefore be mounted laterally of the drum axle in the driving member, etc. without adversely affecting operation.

BRIEF DESCRIPTION OF THE DRAWINGS

A practical embodiment of a thread storing and feeding device according to the invention is illustrated in the drawings.

DETAILED DESCRIPTION

Figure 1:
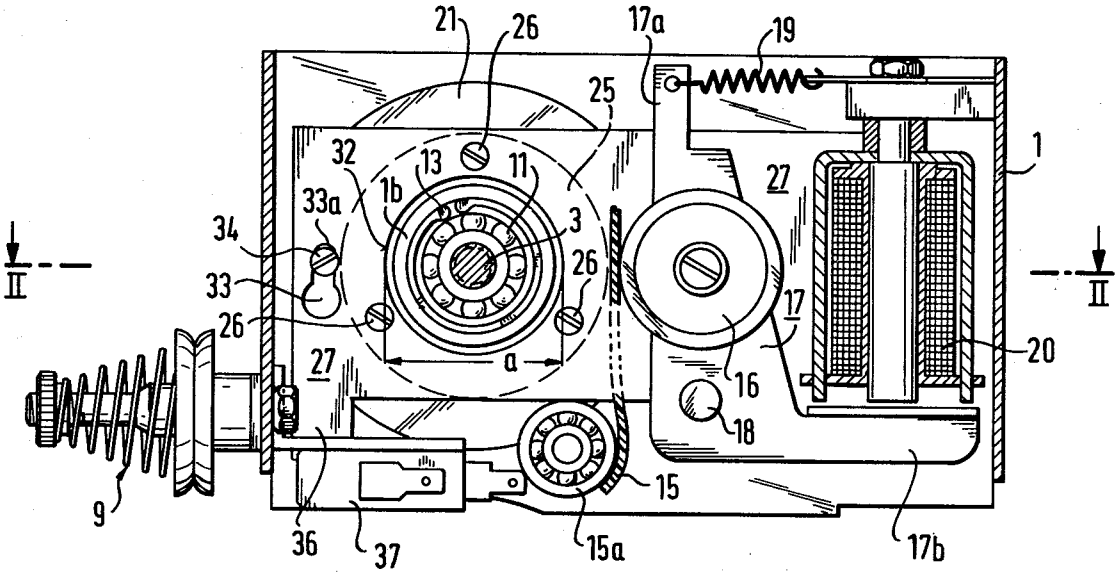
FIG. 1 shows a plan view of the thread storing and feeding device as taken along line I—I in FIG. 2.

The illustrated thread storing and feeding device is intended for a sewing machine. A storage drum generally designated by reference numeral 2 is mounted on a housing 1 by means of a rotatable drum axle 3. Also attached to the outsides of the housing are angle elements 4 and 5 supporting thread guides 6, 7 and 8. In addition, a spring-loaded disc brake 9 is fastened to the housing 1 by means of a bolt 10.

Extending from the bottom 1*a* of the housing near the storage drum 2 into the housing interior is a bearing bush 1*b* integral therewith. Mounted in this bush 1*b* are roller bearings 11 for the drum axle 3, separated by a distance piece 12 and supported by means of a snap ring 13. The free end of the drum axle 3 is rigidly connected to a driving wheel 14 (omitted from FIG. 1 for the sake of clarity). The driving wheel 14 is associated with a drive belt 15 which can be brought into play with the driving wheel 14 by means of a feed roll or idler 16. The feed roll 16 is freely rotatably supported on a bell-crank lever 17 which is mounted so as to be movable about a pivot shaft 18. A tension spring 19 rigidly fixed to the housing engages the arm 17*a* of the bell-crank lever 17 which supports the feed roll 16; the arm 17*b* of the bell-crank 17, extending approximately at right angles to the arm 17*a*, cooperates with an electromagnet 20 in such a manner that upon excitation of the electromagnet the bell-crank lever 17 is pivoted in opposition to the force of the spring 19.

The storage drum 2 is associated with a sliding disc 21 having an edge 21*a* of U-shaped cross section which extends around the edge of the drum near to the housing. From the edge 21*a* fingers 22 extend inwardly through longitudinal slits 2*a* in the drum wall. The sliding disc 21 is mounted on a hub 24 by means of rotary bearings 23, with a slight inclination, about an axis perpendicular to the drum axis — to the rear and at the bottom of the projection plane, which hub encloses the axis of rotation 3 with radial play, i.e. it is vertically adjustable. The hub 24 is rigidly connected to a circular bearing plate 25 which extends above the sliding disc 21 and below the bottom 1*a* of the housing. The bearing plate 25 is supported by means of three screws 26 on a pivot lever 27 which extends in one plane above the bottom 1*a* of the housing 1. The bottom 1*a* has holes 28 for receiving the screws 26.

As can be seen particularly in FIG. 1, the pivot lever 27 is a substantially elongated rectangular plate. Its end 27*a* remote from the storage drum is mounted in the housing 1 at a distance from the drum axle 3 which is at least equal to the radius of the drum. The pivotable mounting consists of a recess 29 on either side of the lever 27 and projections 30 on the housing 1 which engage therein. The lever 27 has a recess 31 which partially surrounds the pivot shaft 18 with play. Lever 27 also has a circular aperture 32 whose diameter *a* (FIG. 1) is greater than the external diameter *b* (FIG. 2) of the bearing bush 1*b*. At its end remote from the bearing, the lever 27 is provided with a slot 33 extending transversely to its longitudinal direction and having two sections of different width. In this connection the narrower area 33*a* lies approximately concentrically with an imaginary longitudinal lever axis passing through the drum axis. A screw 34 which, in addition to its head 34*a*, comprises a shank 34*b* of smaller diameter and, connected thereto, a second section 34*c* having a diameter approximately equal to the head diameter to which the threaded part is connected, is screwed into a tapped hole 35 formed in bottom wall 1*a*. The screw 34 constitutes a stop member for limiting the vertical pivoting movement of the lever 27 which, with the narrower section 33*a* of the slot, extends around the shank section 34*b* between the head 34*a* and the section 34*c* of larger diameter. The slot area 33*a* has a width which is greater than the diameter of the shank 34*b* and less than that of the head and section of greater diameter. The wider section of the slot is dimensioned so that it can be guided over the screw head 34*a*.

The end of the lever 27 remote from the bearing has a nose 36 (FIG. 1) extending from the side at right angles to the main direction in which the lever extends. Mounted above the nose on the housing 1 is a microswitch 37 with a contact 37*a*. The contact 37*a* actuates the microswitch depending on the vertical position of the nose 36.

OPERATION

Figures 2, 3:
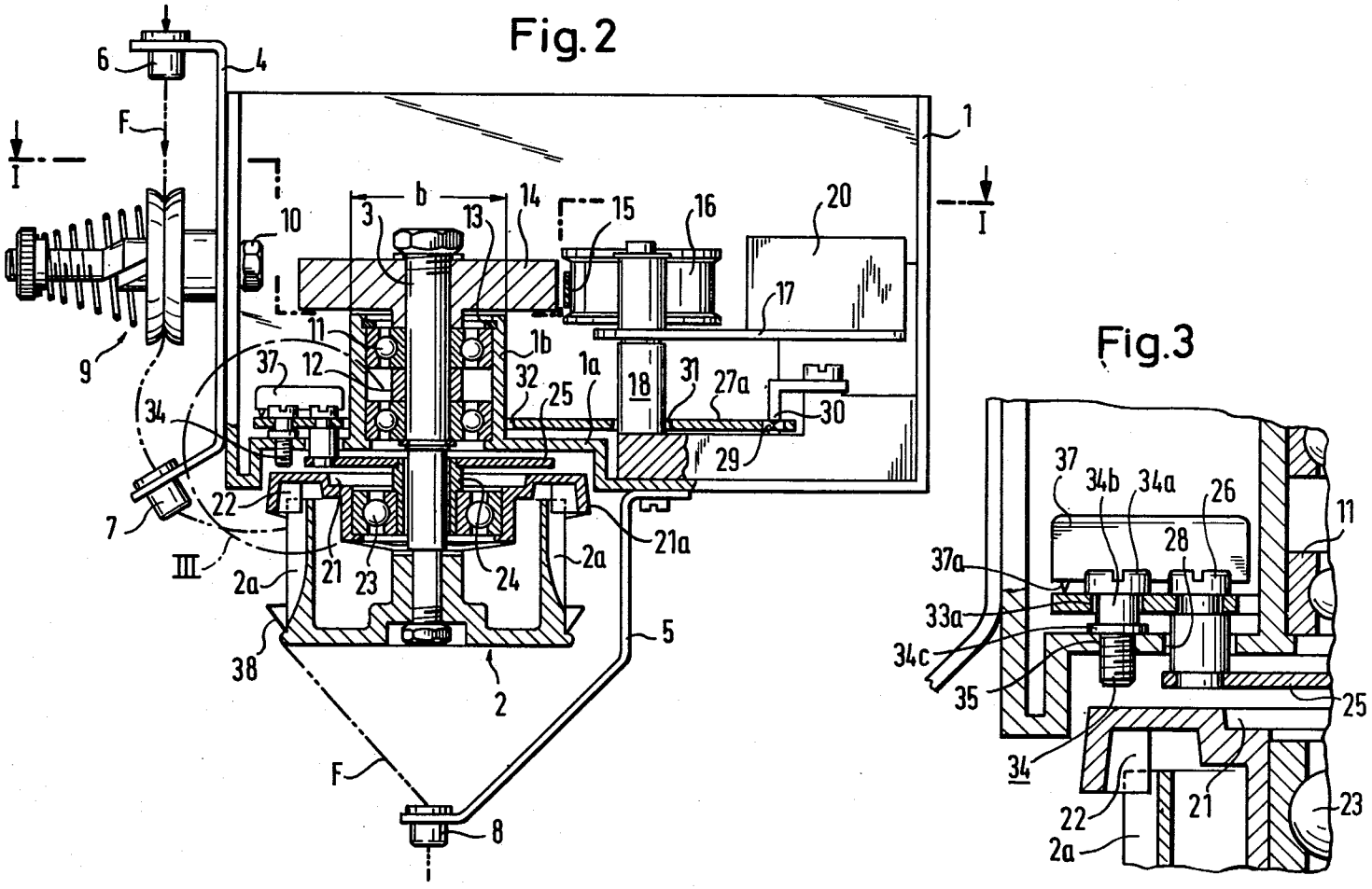
FIG. 2 is a side elevational view, in partial section, as taken along line II—II in FIG. 1.
FIG. 3 shows a detail on an enlarged scale.

The described thread storing and feeding device operates as follows: When the electromagnet 20 is excited, it attracts the arm 17*b* of the bell-crank lever 17 thereby pivoting the lever 17 in opposition to the force of the spring 19 in such a manner that the roll 16 urges the driving belt 15 against the driving wheel 14. The driving belt 15 is moved by a drive (not shown) belonging to the associated machine, and a deflecting pulley 15*a* can be seen in FIG. 1. The rotary motion of the driving wheel 14 is transmitted to the storage drum 2 via the drum axle 3. A thread F, indicated by a chain-dotted line in FIG. 2, is tangentially fed to the drum 2 from a bobbin or the like through the thread guide 6, the disc brake 9 and the thread guide 7. The thread F is wound on to the storage drum 2 by the rotation thereof and forms a thread supply. The formed thread windings are axially moved over the storage drum by the fingers 22 of the sliding disc 21, the thread F is withdrawn overend from the drum under a braking ring 38 and passed on through the thread guide 8, and thence to a sewing needle. The sliding disc 21 is moved, depending on the thread supply on the drum 2, upwards or downwards on the drum axle 3 together with its rotary bearings 23, which causes the drum to rotate also. This motion is transmitted to the lever 27 via the hub 24, the bearing plate 25 and the screws 26, thus causing lever 27 to be pivoted vertically about the pivot defined by 29–30. Thus the nose 36 of the lever 27 is also moved up or down. The microswitch 37 is actuated upon the lever 27 reaching a specified top or bottom position which corresponds to, respectively, a desired or necessary maximum or minimum thread supply. When a maximum thread supply is reached the electromagnet 20 is switched off, the spring 19 draws the bell-crank lever 17 into a position in which the feed roll 16 no longer presses the driving belt 15 against the driving wheel 14, whereby the drum is no longer driven and becomes stationary. No new thread is taken up, the thread supply is used up until the predetermined minimum is reached. In this case the lever 27 is lowered to such an extent that the contact 37*a*, by way of the nose 36, actuates the microswitch 37 and the latter switches the electromagnet 20 on again.

The screw 34 acting as a stop member limits the lever movements beyond the control limits, i.e. when the thread is taken up beyond the maximum thread supply or withdrawn from the minimum supply due to the running down rotary motion of the drum, the sliding disc 21 and therefore the pivot lever 27 can only follow these movements to a limited extent.

The invention is not limited to the embodiment described. In particular the lever arrangement 27 according to the invention can also be provided in thread storing and feeding devices in which the storage drum is stationary and the thread taken up by means of a rotating thread guide member.

The mounting arrangement of the pivot lever 27 at a distance from the drum axle is the essential feature of its design. This method of mounting and the shape of the lever can vary depending on constructional factors. For example, the pivotable mounting of the lever can also be obtained by making the end of the lever away from the drum flexible in design and connecting it rigidly to projections in the housing. The arrangement of the microswitch and the driving members to be actuated thereby can also be varied within broad limits.

Although a particular preferred embodiment of the invention as been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a thread storing and feeding device, particularly for feeding thread in a sewing machine, comprising a housing, a storage drum mounted thereon, to which drum the thread can be tangentially fed to form a thread supply thereon and from which the thread can be withdrawn overend, a sliding disc movable in the axial direction of the storage drum for moving the thread supply over the drum, and a switching device which can be actuated by the axial movement of the sliding disc for controlling a winding drive which causes thread to be wound on the drum, the improvement wherein the sliding disc is supported on a pivot lever, of which the end directed away from the sliding disc is tiltably supported on the housing by a pivot which is located at a distance from the storage drum axle at least approximately equal to the drum radius so that the sliding disk is movable approximately rectilinearly in the axial direction with respect to the drum.

2. A device as claimed in claim 1, wherein the pivot lever directly actuates the switching device for controlling the winding drive.

3. A device as claimed in claim 1, wherein the pivot lever has a section remote from said pivot which extends beyond the center of the storage drum.

4. A device as claimed in claim 3, wherein the pivot lever has an aperture which surrounds the drum axle with radial clearance.

5. A device as claimed in claim 1, wherein the drum axle is rotatably mounted on the housing by means of bearings, and wherein the pivot lever encloses the bearings of the drum axle with radial clearance.

6. A device as claimed in claim 1, wherein the pivot lever is associated with a stop member on the housing which limits the tilting movement of the lever in both directions.

7. A device as claimed in claim 6, wherein the stop member is arranged in the vicinity of the pivot lever end remote from the pivot.

8. A device as claimed in claim 6, wherein the stop member is adjustably mounted on the housing.

9. A device as claimed in claim 7, wherein the stop member is in the form of a screw adapted for screwing into a tapped hole in the housing and having a shank section which is axially defined on either side by sections of greater diameter.

10. A device as claimed in claim 9, wherein the pivot lever has a recess therein which has a dimension lying between the diameter of the shank section and the greater diameter of the adjacent sections, said shank section being positioned within said recess.

11. A device as claimed in claim 1, wherein the pivot lever extends in substantially one plane which is approximately perpendicular to the drum axle.

12. A device as claimed in claim 11, wherein the pivot lever is designed substantially as a plate having a width approximately equal to the drum diameter.

13. A device as claimed in claim 1, wherein the pivot acts as a rocker bearing and comprises recesses formed in the pivot lever which extend around corresponding projections on the housing.

14. A device as claimed in claim 1, wherein the storage drum is rotatably driven by the winding drive, and wherein the pivot lever is connected to a bearing plate arranged between it and the sliding disc, the bearing plate being connected to the sliding disc by rotary bearings.

15. A device as claimed in claim 14, wherein the rotary bearings are mounted on a hub which encloses the drum axle with radial play and is connected to the bearing plate.

16. A device as claimed in claim 1, wherein the sliding disc has an edge of U-shaped cross section which extends around the upper edge of the drum and includes fingers engaging in an inward direction in longitudinal slots in the drum.

17. A device as claimed in claim 1, wherein in the vicinity of its end remote from the pivot, the pivot lever comprises a nose projecting from the side of the lever in the main plane and cooperating with the switching device mounted in this area.

* * * * *